US005142200A

United States Patent [19]

Yamamoto et al.

[11] Patent Number: 5,142,200

[45] Date of Patent: Aug. 25, 1992

[54] METHOD FOR DRIVING A GAS DISCHARGE DISPLAY PANEL

[76] Inventors: Toshihiro Yamamoto; Masahiko Seki; Hitoshi Nakagawa; Takao Kuriyama; Toshihiro Katoh; Hiroshi Murakami, all c/o Nippon Hoso Kyokai Technical Research Laboratory, 10-11, Kinuta 1-Chome, Setagaya-Ku, Tokyo, Japan

[21] Appl. No.: 617,618

[22] Filed: Nov. 26, 1990

[30] Foreign Application Priority Data

Dec. 5, 1989 [JP] Japan ..... 1-314274

[51] Int. Cl.[5] ..... G09G 3/10; G09G 3/22

[52] U.S. Cl. ..... 315/169.4; 340/775; 340/776; 340/805

[58] Field of Search ..... 315/168, 169.1, 169.2, 315/169.4; 340/775, 776, 805

[56] References Cited

U.S. PATENT DOCUMENTS

| | | | |
|---|---|---|---|
| 4,316,123 | 2/1982 | Kleen et al. | 315/169.4 |
| 4,333,039 | 6/1982 | Strom | 315/169.4 |
| 4,368,465 | 1/1983 | Hirakawa | 315/169.4 |
| 4,373,157 | 2/1983 | Holz et al. | 315/169.4 |
| 4,594,588 | 6/1986 | Barclay | 340/805 |
| 4,611,203 | 9/1986 | Criscimagna et al. | 315/169.4 |
| 4,683,470 | 7/1987 | Criscimagna et al. | 315/169.4 |
| 4,754,203 | 7/1988 | Murakami | 315/169.4 |

*Primary Examiner*—Eugene R. LaRoche
*Assistant Examiner*—Michael Shingleton

[57] ABSTRACT

A driving method for a gas discharge display panel especially of a large size. The invention uses a gentle rise-up waveform or stepwise rise-up waveform of the sustaining pulse to allow a more operational margin while not increasing load to the driving circuit.

5 Claims, 12 Drawing Sheets

METHOD FOR DRIVING A GAS DISCHARGE DISPLAY PANEL

BACKGROUND OF THE INVENTION

1. Field of the Invention

The present invention relates to a method for driving a gas discharge display panel.

More particularly, the invention relates to a memory type gas discharge display panel. In this method a sustaining pulse is normally applied between display anodes and cathodes of the device. The sustaining pulse discharge is repeated during a term starting from an application of write-in pulse until an application of an erasing pulse. The time of the sustaining pulse from its rise-up until the establishment of the sustaining voltage is selected to be 150 ns to 500 ns or by arranging the waveform of the sustaining pulse not to increase in one steep slope but to increase stepwisely so that the problem of decreasing margin of the sustaining pulse in a large size display panel due to an increase of inductance in the electrodes and interelectrode capacitance can be solved.

2. Prior Art Statement

A method for improving luminous intensity of a gas discharge display panel by providing a memory function in a gas discharge display panel, which is so-called as a "memory driving system" had been patented for the applicant under Japanese Patent No. 1,486,701 with a title "A method for driving a gas discharge display panel". One embodiment of the discharge display panel using the driving method of this patent is shown briefly in FIG. 11.

Further, FIG. 12 is one embodiment of voltage waveform of driving voltage in a recent prior technique (Japanese Patent Application No. 1-272,919 by the present applicant entitled as "Method for driving gas discharge display panel"). The operating principle of said "pulse memory driving" will be explained briefly hereinafter.

A constant period sustaining pulse SP is normally applied to the display electrode $D_j$ periodically. The amplitude $V_{sp}$ and the pulse width $T_p$ of this sustaining pulse SP are previously selected to have such a value that a pulse discharge started by write-in pulse WP can be sustained even after the termination of the write-in pulse. Scanning pulses SKP are applied successively from first row cathodes. In an auxiliary cell $AC_{ij}$, an auxiliary discharge is ignited at an auxiliary cathode $A_j$. At a display cell $DC_{k(2j-1)}$, a write-in discharge is started together with a write-in pulse being applied to a corresponding display anode at a substantially same timing with the scanning pulse SKP. The auxiliary cell $AC_{ij}$ and the display cell $DC_{k(2i-1)}$ or $DC_{k(2j)}$ are coupled by ionization through microscopic space. The write-in discharge is started very quickly to be full discharge condition by the aid of the auxiliary discharge. In order to stop the sustaining discharge at a display cell, an erasing pulse ERS is to be applied to a corresponding cathode to stop the sustaining pulse discharge once or more.

When displaying a picture having half tone scene, like a television picture, it is necessary to shorten the write-in period of one row to about 4 μs (in case of FIG. 12, this period is equal with the period of the sustaining pulse ($T_{SP}$). In order to effect stable and high speed write-in, the pulse width of the access scanning pulse (SKP) requires a length of at least 2 μs. As can be seen from the same diagram, the pulse width $T_p$ of the sustaining pulse is made at the most 1.7 μs.

When driving a panel by using the conventional pulse waveform as shown in FIG. 12, a stable memory operation is possible only for a small size panel and only when a wide memory margin had been kept. However, when the panel size becomes large or a case of high discharge voltage and hence the pulse voltage is needed to increase, a stable memory operation becomes difficult.

In order to solve this problem, the inventors had examined the actual phenomena of discharge in detail and found the following.

(1) At some particular regions, erroneous discharge tends to be produced. By changing the driving side of electrodes, such regions appeared in a symmetrical position.

(2) The built up of wave front of light of the sustaining pulse discharge in the above region was substantially speedier compared with that of other regions.

The above two points may be explained by the following.

On the discharge display panel having the construction as shown in FIG. 11, both the anodes and cathodes are arranged in parallel respectively and facing each other at short distance. Namely the discharge cells are arranged in a matrix. Each cell is formed by a cathode and an anode. The equivalent circuit diagram of this panel is considered to be as shown in FIG. 13 considering the capacities between the electrodes and the inductances in the electrodes. FIG. 13 shows a case having two rows and two columns. In this figure, capacitance $C_A$ between two adjacent display anodes, capacitance $C_K$ between two adjacent cathodes, capacitance $C_O$ between a display anode and a cathode, resistance $R_A$ and inductance $L_A$ of the anode and resistance $R_K$ and inductance $L_K$ of the cathode have been considered. These are defined as panel circuit parameters.

When the conventional sustaining pulses are applied to this circuit, oscillation is produced in the waveform by the above panel circuit parameters, together with resistance, capacitance and inductance components of the driving circuit system. Since the position in the panel is different for each of the discharge cells, the circuit parameters except capacitance will vary for each of the discharge cells and thus the amplitude of the oscillation or the like will vary depending on the location of the cells in the panel. At a cell having large oscillation amplitude, an abnormally high voltage is produced by the applied pulses which might lead to an erroneous discharge. As a result of this phenomena, a particular region of the panel tends to cause an erroneous discharge and rise-up time of the discharge becomes shorter.

As the method for decreasing such kind of oscillation, it has been considered to vary the circuit parameters. As stated above, in order to prevent an increase of oscillation amplitude of voltage producing in a particular region of the panel, it is required to eliminate any difference of the circuit parameters for all the locations. Thus the difference or deviation of the circuit parameters including the driving circuit system should be made extremely small. However, it is impossible to vary the circuit parameters of the discharge display panel substantially in view of its construction. Furthermore, the parameters other than the capacitance $C_O$ vary greatly when the size of the discharge display panel becomes larger. Namely, the parameters are smaller at an area near the driving end and larger at the side opposite to the driving end. From this, it is expected that at somewhere in the panel, an oscillation may tend to occur.

As has been explained above, in the conventional driving method, the waveform of the sustaining pulse has a shape of a single pulse having a very steep rise-up portion which varies from zero potential to a potential $V_{SP}$ very rapidly. By this reason, the sustaining pulse waveform will have an oscillation by the components of resistance in the discharge panel, and capacitance, and inductance thereof and hence an excess voltage is induced between the display anodes and cathodes so that erroneous discharges tend to occur. According to an increase of the panel size, the circuit parameters of the discharge display panel may vary extensively and sustaining pulse margin can hardly be obtained in such a large size panel. Here the sustaining pulse margin is defined by the following equation:

$$(V_{SP})\max-(V_{SP})\min$$

wherein, $(V_{SP})$min is a minimum voltage to keep the sustaining pulse discharge $(V_{SP})$max is a maximum voltage which can be applied to the panel in which non-accessed cells will not cause erroneous discharge.

When this value is positive, there exists a margin. If it is negative there is no margin at all and no memory operation is effected.

On the other hand when a television picture or the like is to be displayed, the writing-in period is restricted as mentioned above. By this reason, the width of the sustaining pulse including the rise-up time can not be so long. Furthermore, since one each of such driving circuit is needed for each one electrode, the total number of the driving circuits correspond with the number of electrodes. This means that the driving circuit better be made in a simple construction and for the driving voltage to be kept as low as possible. Since the number of the electrodes increases as the panel becomes larger, the above requirement is more stringent for a large size display panel. As mentioned above, for driving a large size panel, the pulse width of the sustaining pulse is delimited and the durable voltage is also limited in view of the circuit construction so that the above decrease of the sustaining pulse margin should be dealt with.

SUMMARY OF THE INVENTION

The present invention has for its object the realization of a method for driving a gas discharge display panel in which the sustaining pulses need not be increased from the zero potential to the potential $V_{SP}$ in one step, or in other words without shifting to the pulse potential in one step within a very short period of time, and also the waveform oscillation due to deviation of the circuit parameters of the discharge panel can be suppressed substantially to secure the sustaining pulse margin and at the same time not hindering the high speed response required for the display of a television picture while keeping the complication of the driving circuit to a minimum extent.

In order to solve the problem, the first method for driving a discharge display panel of pulse memory type comprising at least two set of electrodes arranged oppositely to form a plurality of discharge cells arranged in matrix form, wherein said discharge cells are applied with sustaining pulses intermittently so that a sustaining pulse discharge started by a write-in pulse may continue until an application of an erasing pulse, the invention is characterized in that duration taken from beginning of rise-up of the sustaining pulse and establishment of the sustaining pulse voltage is set at 150 ns to 500 ns.

In the second method of the invention a method for driving a discharge display panel of pulse memory type comprising at least two set of electrodes arranged oppositely to form a plurality of discharge cells arranged in matrix form, wherein said discharge cells are applied with sustaining pulses intermittently so that a sustaining pulse discharge started by a write-in pulse may continue until an application of an erasing pulse, the invention is characterized in that the waveform rise-up portion of the sustaining pulse is arranged to show stepwise form.

According to the method of the present invention, at driving the electrodes of the gas discharge display panel, the time between rise-up of the sustaining pulse to an establishment of sustaining voltage is made relatively longer, or to make the rise-up waveform of sustaining pulse stepwisely so that the rise-up of the sustaining pulse waveform will not rise in one step. By this arrangement, the decrease of margin of the sustaining pulse due to an increase of inductance in the electrodes or that of inter electrode can be solved.

DETAILED EXPLANATION OF THE PREFERRED EMBODIMENTS

Figure 1:
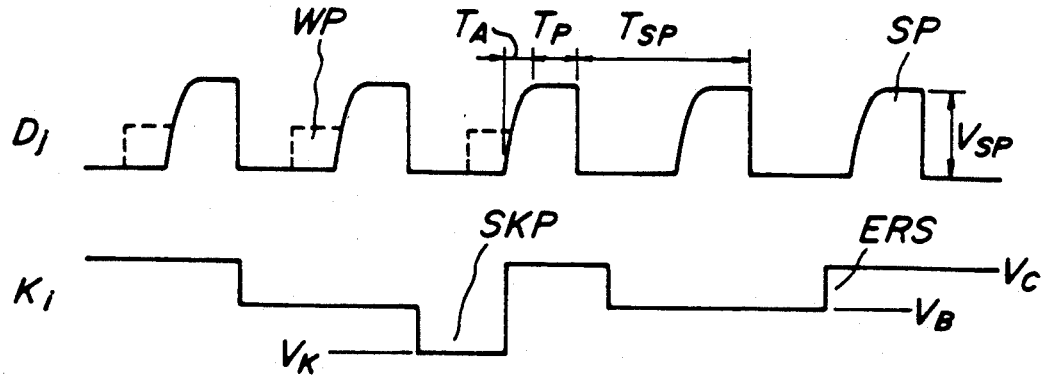
FIG. 1 shows a first embodiment of the electrode driving waveform according to the present invention.

The present invention will be explained in more detail by referring to the accompanying drawings:

FIG. 1 shows basic waveforms for driving electrodes in a first embodiment of the present invention. In the first embodiment, the rise-up portion of the sustaining pulse $S_p$ applied to a display anode $D_j$ has a gentle slope or less steep inclination. The voltage waveform applied to the cathode $K_i$ has basically no difference from the conventional embodiments.

By arranging gentle rise-up for the sustaining pulse, the amount of oscillation per time is decreased. By this arrangement, the amplitude of oscillation even produced by the circuit parameters of the discharge display panel can be suppressed within a certain extent.

Figure 2A:
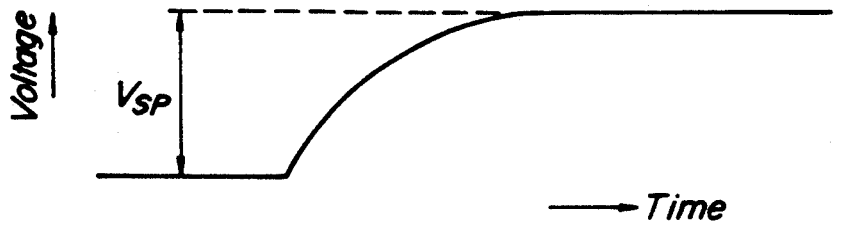
FIGS. 2*a*, 2*b* and 2*c* show several practical embodiments of rise-up time of the sustaining pulse waveform of the first embodiment.
Figure 2B:
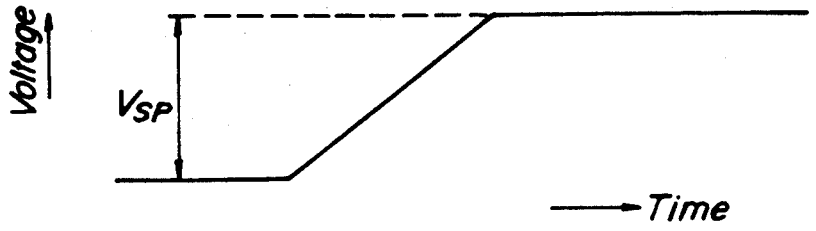
Figure 2C:
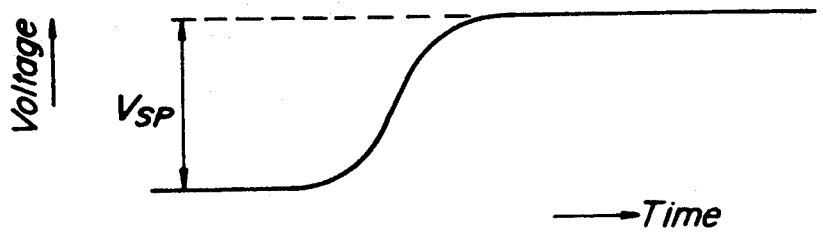

Various waveforms are considered as the rise-up waveform of the sustaining pulse. Several embodiments of the waveform are shown in FIGS. 2a to 2c. FIG. 2a shows a rise-up waveform in an exponential function, FIG. 2b shows linear rise-up waveform and FIG. 2c shows cosine waveform rise-up. The difference of voltage waveforms caused from these different waveforms has been examined by calculation. In the calculation, cells located at four corners of the display panel are considered and an equivalent circuit diagram shown in FIG. 3 is used.

Figure 3:
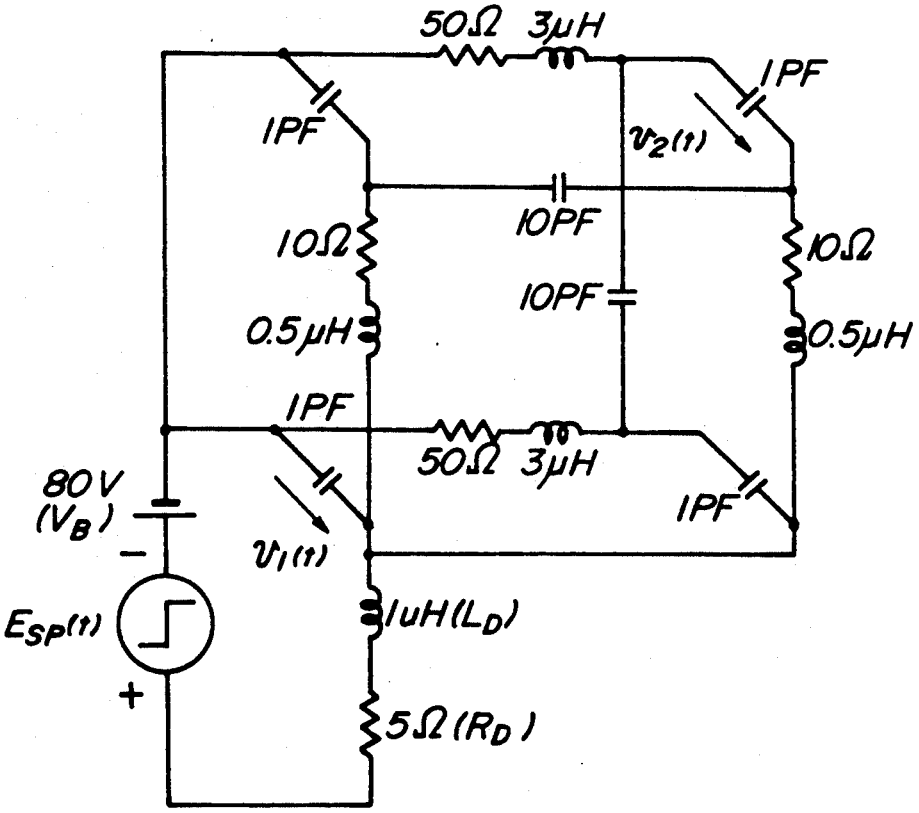
FIG. 3 shows an equivalent circuit diagram used in the simulating calculation.

In FIG. 3, $L_D$ and $R_D$ represent respective inductance and resistance integrally in the driving circuit and between the driving circuit and the panel. The actual value of the parameters shown in the drawing had been decided by using a panel explained hereinafter. $E_{SP}$ represent the sustaining pulse ($V_{SP}$=150 V). A bias voltage ($V_B$=80 V) is also applied to the panel, $v_1(t)$ and $v_2(t)$ are two actual voltages applied to the discharge cell and these two values are calculated. In the actual display panel there are many electrodes and a more precise equivalent circuit becomes much too complicated. Whereas in FIG. 3, a simplified form of circuit consisting of 2 cells×2 cells is considered so there might be some difference from the actual waveform. However, it is sufficient to observe the difference of behaviour of oscillation and the result is in coincident with the result of experiment relating to the margin of the maintaining pulse.

The voltages applied to the discharge cells had been calculated in the case of applying the waveforms shown in FIGS. 2a, 2b and 2c and that of conventional one. The result is shown in FIGS. 4a to 4d.

Figure 4A:
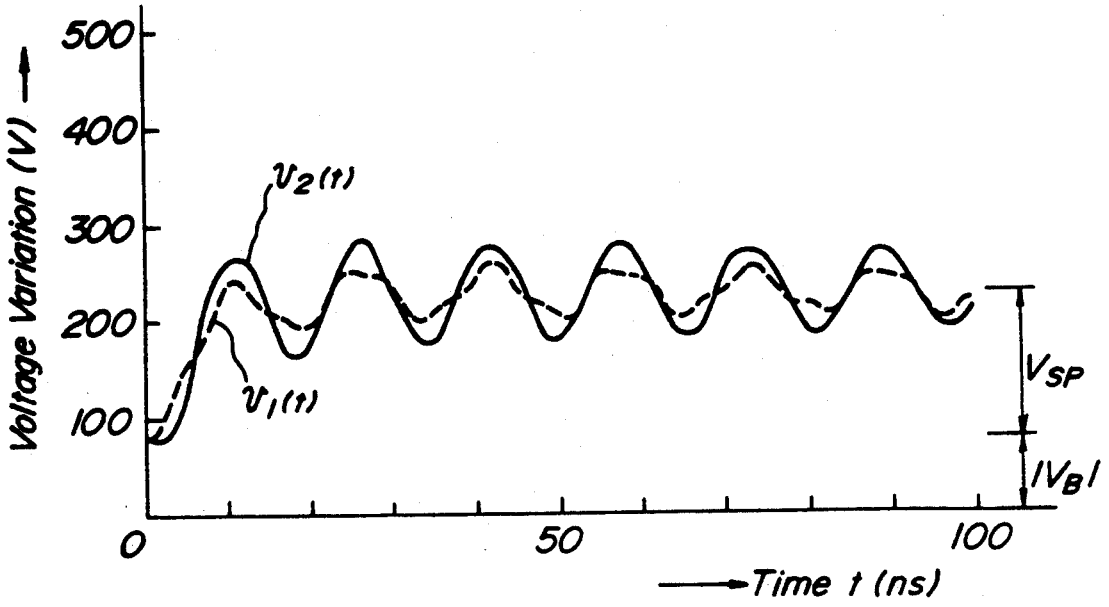
FIGS. 4*a*, 4*b*, 4*c* and 4*d* show several resultant voltage waveforms being applied between cells obtained by calculation.
Figure 4B:
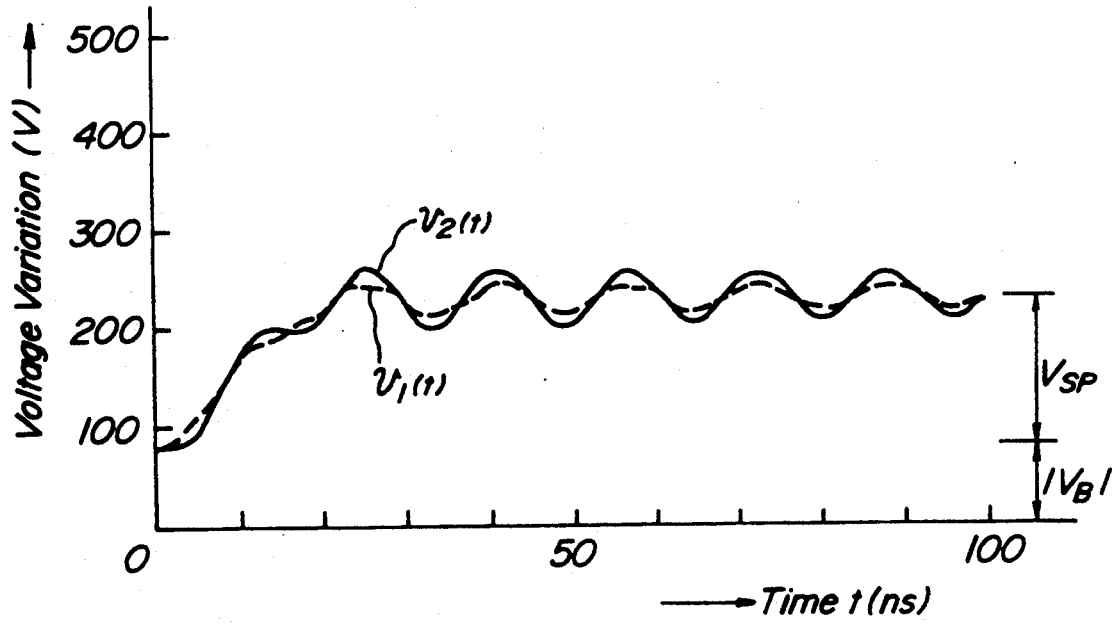
Figure 4C:
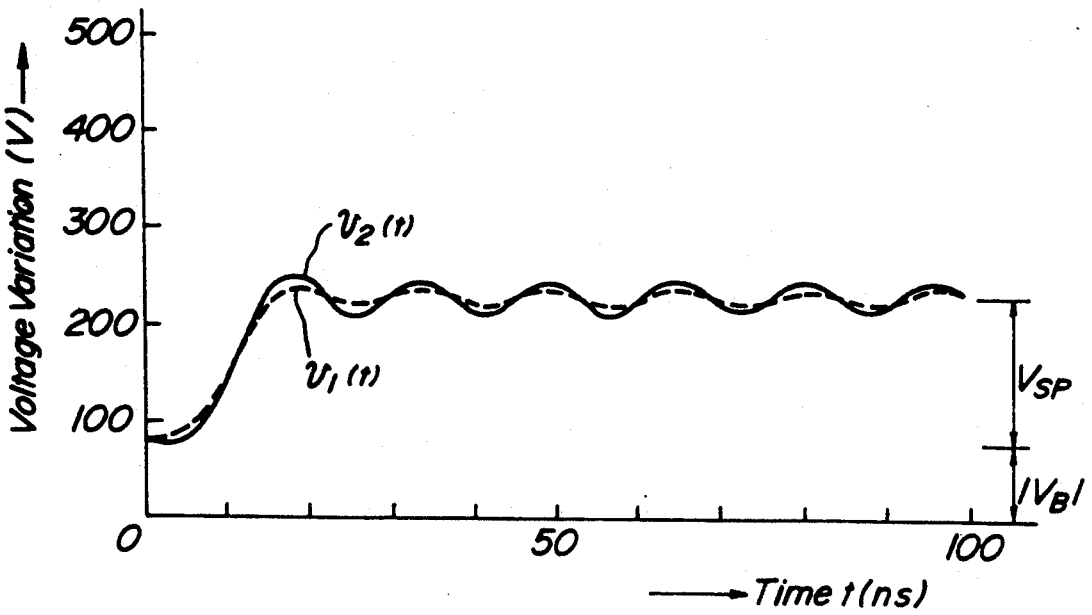
Figure 4D:
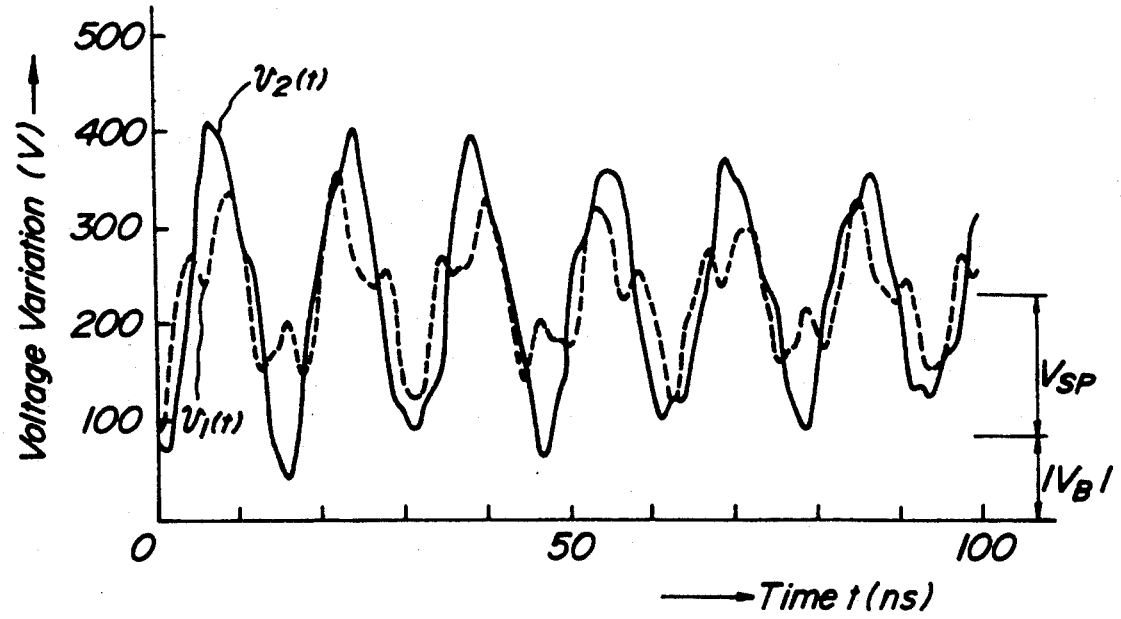
FIG 4d PRIOR ART

FIG. 4a shows the rise-up curve according to exponential function. This curve reaches 95% of the nominal voltage $V_{SP}$ within 20 ns. FIG. 4b shows linear rise-up and FIG. 4c shows cosine wave rise-up and both these curves reach the nominal voltage $V_{SP}$ within 20 ns. In the present invention, rise-up time of the sustaining pulse is proposed in a range of 150–500 ns. If this range is used in the calculation, it becomes unclear the variation of the waveform when the result of calculation is shown by drawing so that the rise-up time of the sustaining pulse is assumed as 20 ns. FIG. 4d shows an embodiment of a conventional waveform showing a steep rise-up wave front. In this conventional embodiment the peak of oscillation is nearly double the height of that of the applied voltage. Whereas in the case of gentle rise-up of pulses as shown in FIGS. 4a to 4c, the oscillation of waveform is substantially suppressed compared with FIG. 4d having a steep rise-up waveform. In the former cases, also the variation of applied voltage between cells is decreased. In the above, the calculation was carried by assuming the rise-up time of the sustaining pulse as 20 ns. However, it is apparent that more effect can be expected by using the rise-up time as 150 ns.

Figure 5A:
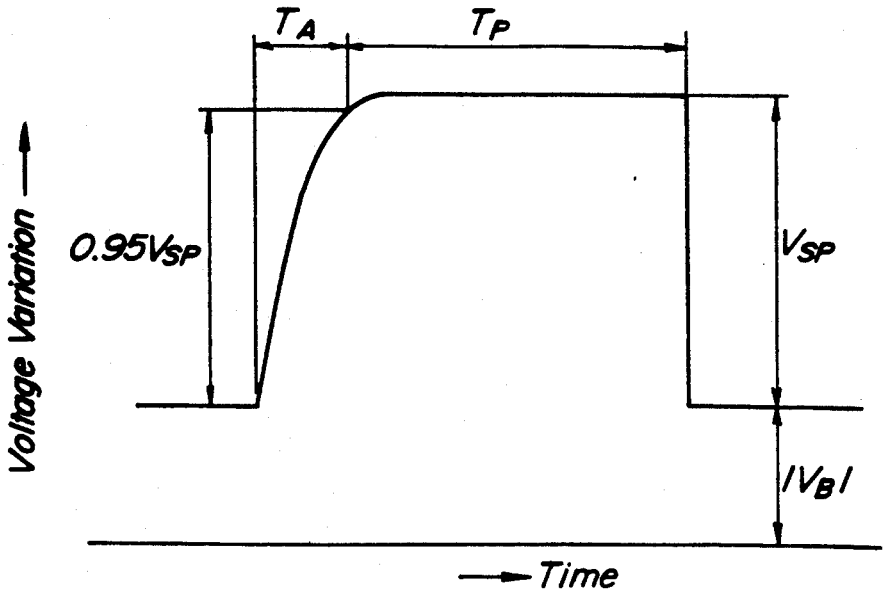
FIGS. 5*a* and 5*b* show the voltage waveform being applied to the cells in the embodiment shown in FIG. 1.
Figure 5B:
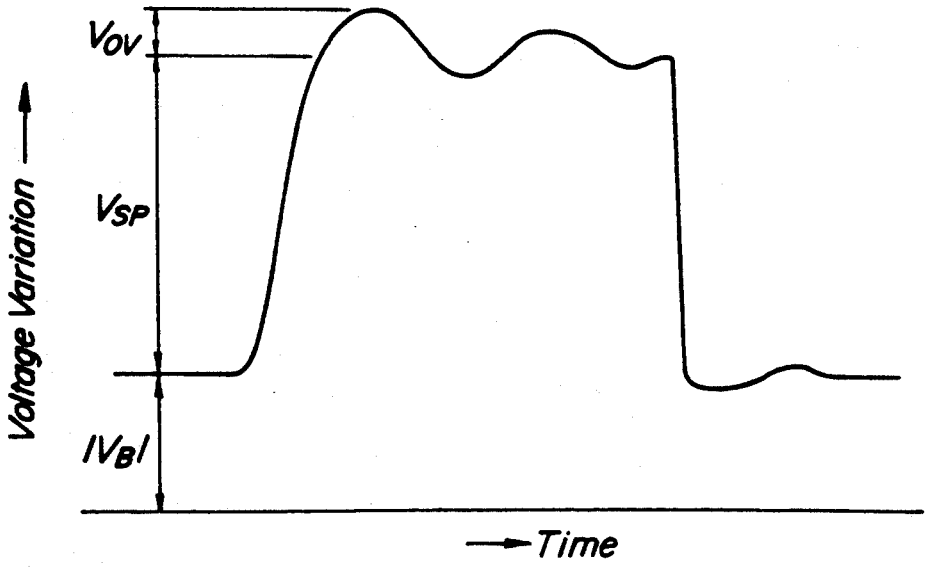

The relation between the time of rise-up of the sustaining pulse and establishing of the same and margin for the sustaining pulse will be considered. As for example, FIGS. 5a and 5b show the voltage waveform being applied to the cell when a pulse voltage having exponential rise-up is applied to the discharge display panel. FIG. 5a shows an ideal case waveform having no oscillations. FIG. 5b shows a more practical waveform. $V_{SP}$ is the voltage of sustaining pulse, $V_{OV}$ the maximum value of the oscillation voltage, $T_A$ the time required between the rise-up of the sustaining pulse and establishing of the same pulse (when exponential rise-up waveform is used, the time until reaching 95% of sustaining pulse voltage $V_{SP}$), $T_P$ the pulse width of the sustaining pulse and $V_B$ is the bias voltage of the cathode. The erroneous discharge is usually produced when $V_{SP}+V_{OV}$ becomes high. In order to suppress this erroneous discharge, the rise-up time $T_A$ should be longer than a certain value. This can be deducted from the waveform shown in FIG. 5b and from the result of simulation. The range of $T_A$ is obtained from experimental results.

Figure 6:
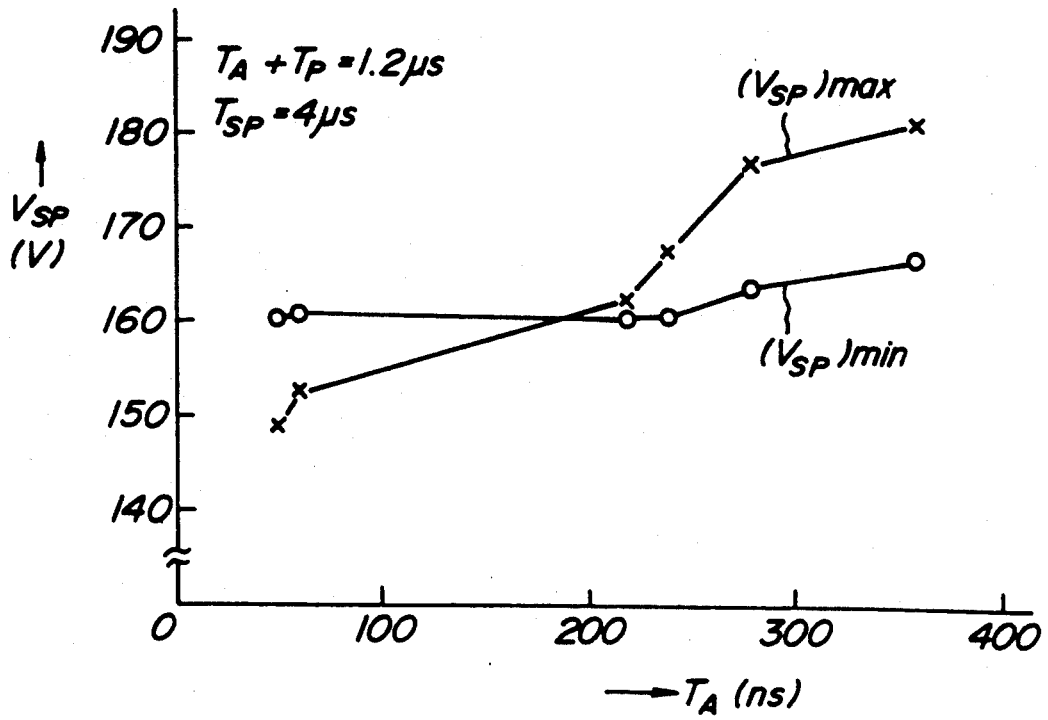
FIG. 6 shows a relation between the rise-up time of the sustaining pulse and the voltage margin of the sustaining pulse.

FIG. 6 shows a result of measurement for a flat structure type discharge display panel having about 500×640 cells (reference is made to Murakami et al: Research Study Report No. ID 88-37 of Research Group of TV Institute) driven by sustaining pulse period of $T_{SP}$=4 μs. The discharge was effected to produce a checkered pattern by selecting discharge cells. The rise-up of the sustaining pulse was an exponential form. In FIG. 6, $(V_{SP})$min is the minimum sustaining pulse voltage under which all the selected pulses will keep sustaining discharge. $(V_P)$max is the maximum sustaining pulse under which non-selected cells keep the sustaining discharge without causing erroneous discharge. FIG. 6 shows the sustaining pulse voltage $(V_{SP})$min and $(V_{SP})$max against varying $T_A$. When $T_A$ is selected about 200 ns, the margin is secured as follows.

$$(V_{SP})\max-(V_{SP})\min>0$$

This margin will not vary more even if $T_A$ is made longer. Other experimental results showed almost the same tendency. It had been confirmed that if $T_A$ is in a range longer than 150 ns, a margin is secured at any rate.

Whereas the access period of a row is decided as a certain length, the time length of the sustaining pulse is limited and in the television picture indication etc., the maximum pulse width is about 1.7 μs. As can be seen from this fact if the rise-up time $T_A$ is made longer, the pulse width of the sustaining pulse becomes insufficient so that the voltage $V_{SP}$ of the maintaining pulse need to be higher accordingly. FIG. 6 already shows such tendency. Although it is not shown in this drawing, if the rise-up time $T_A$ becomes more than 500 ns, $(V_{SP})$min shows remarkable increase so that bearing load for the driving circuit will increase. From this fact it has turned out that by limiting the rise-up time $T_A$ within 150 ns to 500 ns, good driving is possible, in which a practically enough margin can be obtained and the load to the driving circuit is decreased.

The first embodiment has an object to suppress the oscillation amplitude by decreasing the amount of time variation of the applied voltage. As can be seen from the result of simulation by arranging the rise-up waveform of the sustaining pulse in linear form or cosine waveform, the oscillation voltage applied to the discharge cell will decrease and a same result can be obtained. It is apparent that by arranging the rise-up waveform more gentle or slack in other waveform the same effect can be obtained.

The gentle waveform of the sustaining pulse as has been explained with respect to the first embodiment can easily be realized by means of the conventional circuit technique. For instance, a switching transistor for forming the sustaining pulse is operated as class A amplifier during the rise-up time of the pulse. Namely, by providing a circuit having a resistance R and a capacitance C in the primary side of the transistor, an exponential rise-up can be obtained. Further by providing a circuit having an inductance L and a capacitance C, the waveform can be changed into cosine waveform and by providing a capacitance and a constant current circuit a linearly varying waveform can be obtained. As has been mentioned above, a sustaining pulse having a gentle rise-up waveform produced in general for a plurality of display modes may be supplied to the anodes by mixing in a circuit having diode and the respective pulse generating circuit for the write-in pulse for the respective display anodes. By this the increase of circuit element per display anode can be kept small.

In the foregoing explanation relating to the first embodiment, an assumption was made that the device is DC type pulse memory panel driving. However, it is apparent that the idea in the first embodiment can be equally applied to an AC type panel driving.

Figure 7:
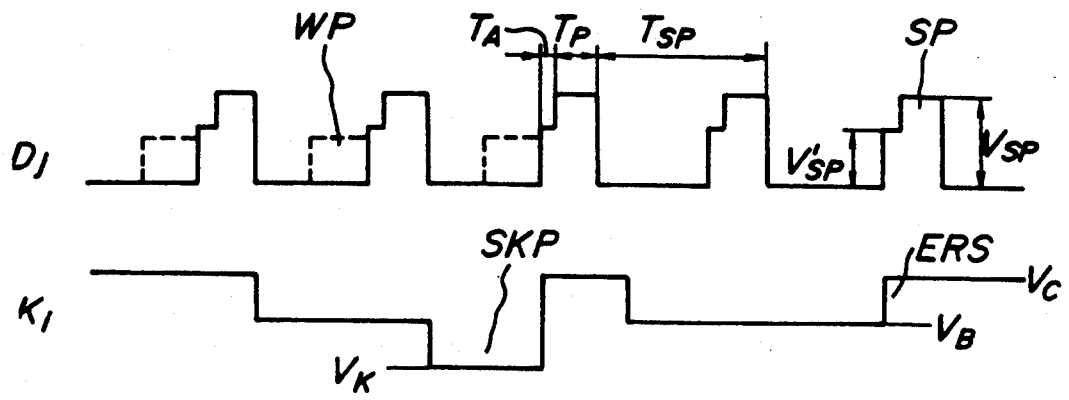
FIG. 7 shows a second embodiment of the electrode driving waveform according to the present invention.

Now FIG. 7 shows basic electrode driving waveforms according to a second embodiment of the present invention. In this second embodiment, the rise-up portion of the sustaining pulse has stepwise waveform. The waveform of voltage applied to the cathode is the same as the conventional one.

By arranging the rise-up portion of the sustaining pulse stepwisely, the voltage variation in one step can be decreased. Accordingly, even an oscillation might be caused by the circuit parameters of the discharge display panel, the amplitude of the oscillation can be suppressed since the amount of momentary variation of the applied voltage is kept at low value.

Although any stepwise waveform may have an effect, the conditions for obtaining an optimum waveform will be considered herein after. Some voltage waveforms appearing at cells by applying voltage of the above waveforms are shown in FIGS. 8*a* and 8*b*.

Figure 8A:
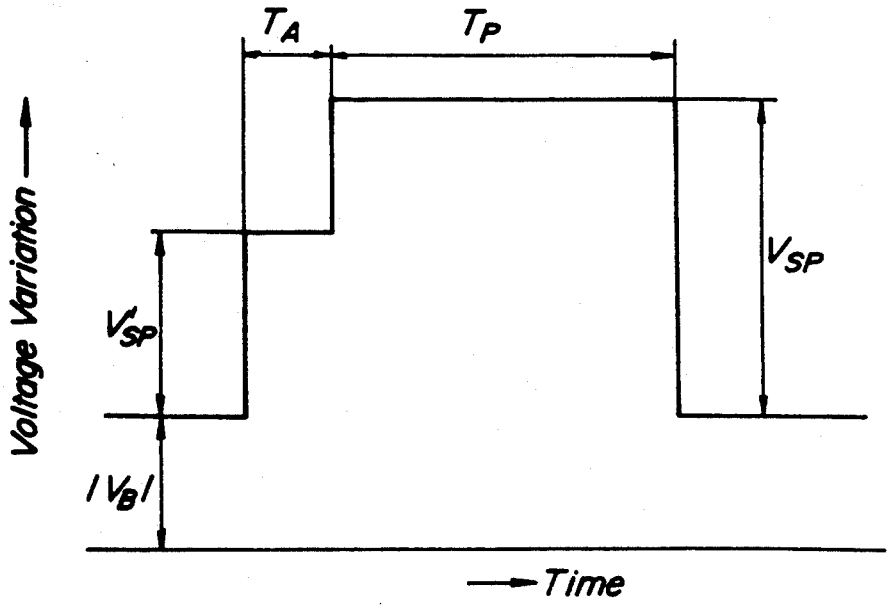
FIGS. 8*a* and 8*b* show voltage waveforms applied to the cells by the sustaining pulse in the second embodiment.

FIG. 8*a* shows an ideal waveform, wherein no oscillation is produced. FIG. 8*b* shows a more practical waveform. In these figures, $V_{SP}'$ shows a first step voltage of the sustaining pulse, $V_{VO}'$ a maximum value of the oscillation voltage caused by the first step pulse, $V_{SP}$ a voltage for starting the sustaining pulse discharge by the second step pulse, $V_{OV}$ is a maximum value of the oscillation voltage by the second step pulse, $T_A$ pulse width of the first step pulse, $T_P$ pulse width of the second step pulse, $V_B$ is bias voltage. In the period $T_A$, an oscillation is caused by the first step pulses and in the period $T_P$ an oscillation is caused by the second step pulses.

Figure 8B:
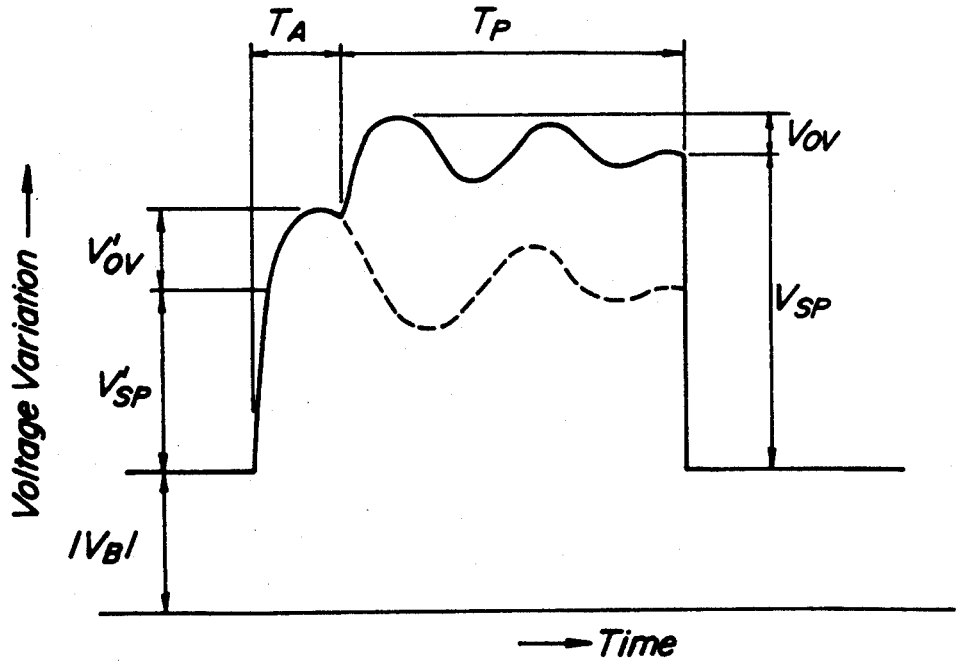

Since the erroneous discharge by the waveform oscillation is caused when $V_{SP}+V_{OV}$ becomes a high value, the following conditions are presumed from FIG. 8*b* to suppress the erroneous discharge.

(1) $V_{SP}$ and $V_{SP}'$ are in optimum range
(2) $T_A$ is within a certain range.

The optimum range of these parameters can be obtained from experiments.

Figure 9:
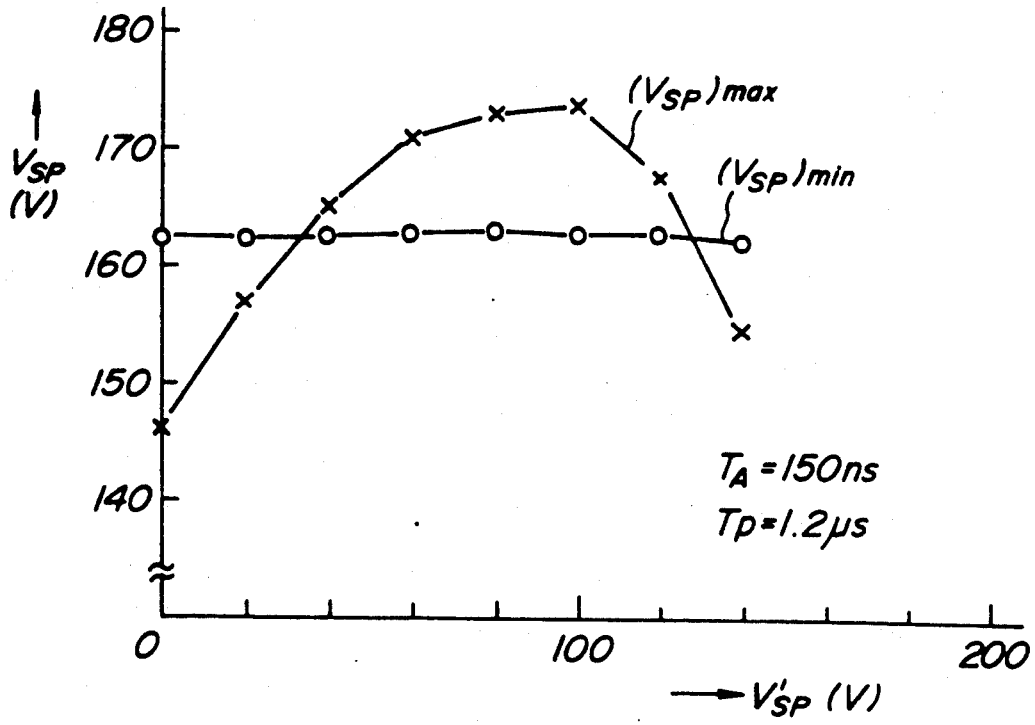
FIG. 9 shows a relation between a first step sustaining pulse voltage and the sustaining voltage margin in the second embodiment.
Figure 10:
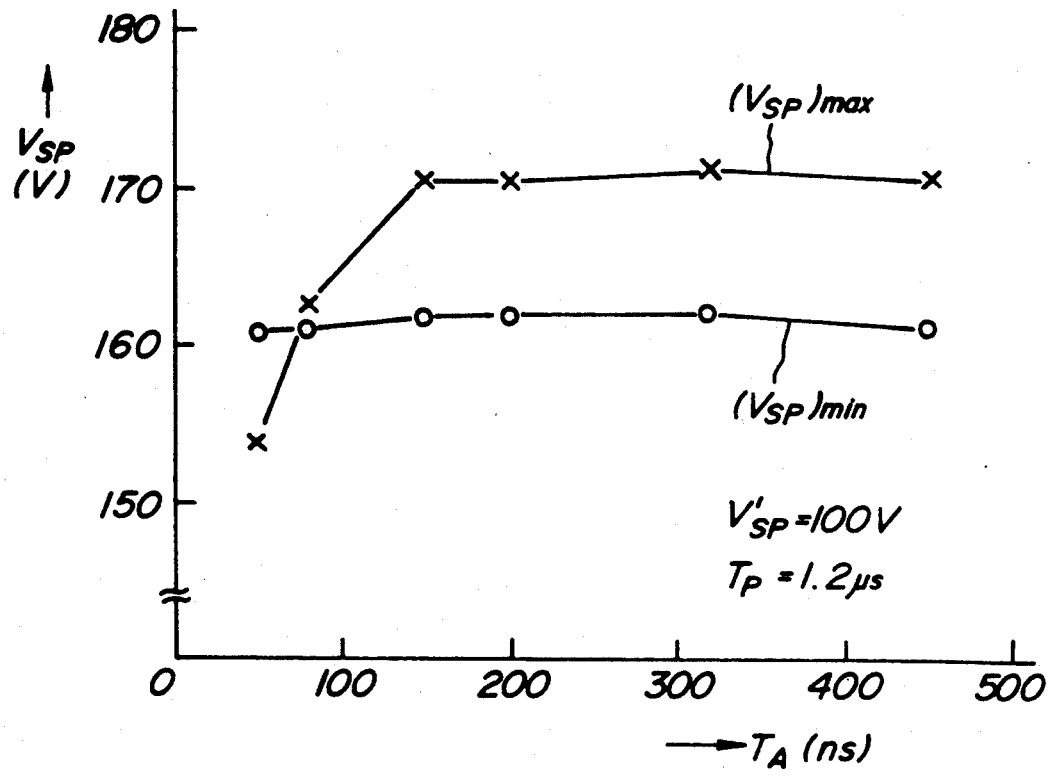
FIG. 10 shows a relation between a first step sustaining pulse width and the sustaining voltage margin in the second embodiment.
Figure 11:
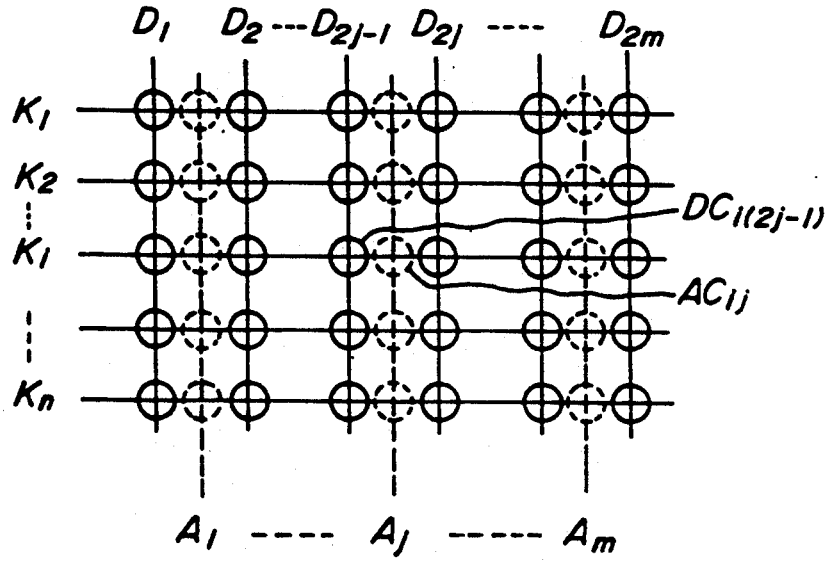
FIG 11 PRIOR ART
FIG. 11 shows one embodiment of construction of the discharge display panel in which the inventive method can be applied.
Figure 12:
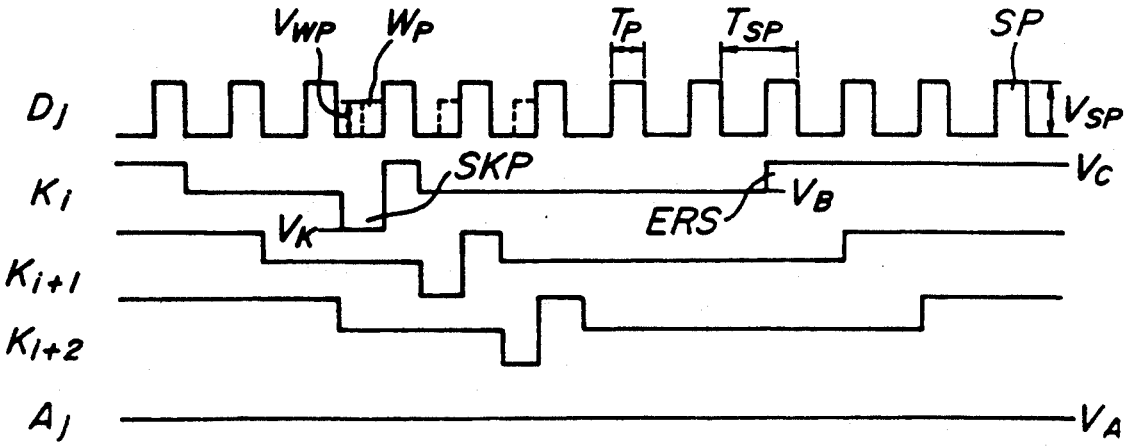
FIG 12 PRIOR ART
FIG. 12 shows a prior art electrode driving waveform.
Figure 13:
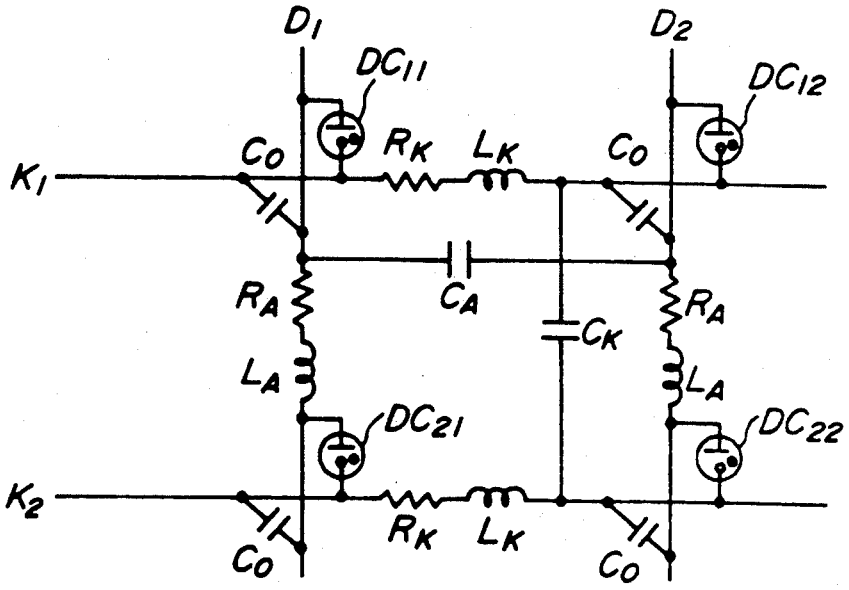
FIG. 13 shows an electric equivalent circuit of the discharge display panel to which the present invention can be applied.

FIG. 9 and FIG. 10 show result of measurement when 500×640 cells plane structure type discharge display panel (refer to Murakami et al: TV institute for picture display research report ID 88-37) is driven at sustaining pulse period $T_{SP}=4$ μs. These FIGS. 9 and 10 show a margin of sustaining pulse voltage when the discharge is effected by selecting the discharge cell in a checkered pattern. In these figures, $(V_{SP})$min is the minimum sustaining voltage at which all the selected discharge cells keep sustaining discharge and $(V_{SP})$max is the maximum sustaining pulse voltage at which the non-selected cells keep only sustaining pulse discharge and without causing an erroneous discharge.

FIG. 9 shows sustaining pulse voltages $(V_{SP})$min and $(V_{SP})$max for constant $T_A$ and varying $V_{SP}'$. In the range of 50 V to 120 V of the first step voltage $V_{SP}'$ of the sustaining pulse, the following margin can be obtained.

$$(V_{SP})\text{max}-(V_{SP})\text{min}>0$$

$V_{SP}'=0$ represents the conventional waveform. In such known practice, $(V_{SP})$max is substantially lower than $(V_{SP})$max, i.e.:

$$[(V_{SP})\text{max}-(V_{SP})\text{min}>0]$$

and no margin is obtained.

FIG. 10 shows sustaining pulse voltages $(V_{SP})$max and $(V_{SP})$min for constant $V_{SP}'$ and varying $T_A$. If $T_A$ is selected about 100 ns, the following margin is obtained.

$$(V_{SP})\text{max}-(V_{SP})\text{min}>0$$

For $T_A$ values longer than 150 ns the margin will not vary substantially.

On the other hand the access time for one row is decided in a certain length so that the time duration of the sustaining pulse has a certain limit. For the television picture display its maximum length is about 1.7 μs or so. As Can be Seen from this fact if $T_A$ is longer, a sufficient pulse width of the sustaining pulse is not assured and it may become necessary to select longer $V_{SP}$. In FIG. 10 as the length $T_A$ is constant, there is no increase of $V_{SP}$. But for $T_A$ value longer than 50 ns, the sustaining pulse may overlap with the scanning pulse and the erroneous discharge will be produced everywhere and thus access becomes impossible.

Although it has not been shown in the drawing, when $T_P+T_A$ is kept constant and if $T_A$ is selected to be longer than 500 ns, $(V_{SP})$min becomes a remarkably high value and thus the load for driving circuit becomes very large. By limiting the value of $T_A$ in a range of 100 ns–150 ns, without having decrease of the margin and a stable driving without unduly high load to the driving circuit can be realized.

The other experiments have shown the same tendency. Namely, within the range of:

(1) $V_{SP}'=30\sim80\%$ of $V_{SP}$
(2) $T_A=100$ ns–500 ns margin of voltage is obtained and no problem for the circuit load is applied.

The second embodiment has its object to suppress the oscillation by decreasing momentary variation of the applied voltage. It is apparent that a same result can be obtained to arrange the sustaining pulse waveform as three steps or more although the circuit configuration becomes somewhat complicated.

It is also apparent that the driving method of the second embodiment can effectively be used in combination with the first embodiment to make the rise-up part of the sustaining pulse more gentle.

In the foregoing explanation of the second embodiment, the driving method is for driving DC type pulse memory panel. However, the same effect is expected in using the invention for AC type panel driving.

The stepwise waveform of the sustaining pulse explained as the second embodiment of the invention in the foregoing can easily be formed by using the conventional circuit technique. For example, multi-step sustaining pulses are produced altogether and such pulses may be mixed with respective write-in pulse for each display anode in a diode or the like. By this the increasing number of elements per display anode can be kept minimal.

As a similar driving method with the second embodiment, a system is known in which two stepwise portions are arranged at the front and rear portions of the sustaining pulse in order to reduce the reactive component of power produced for charging and discharging the inter electrode capacity. However, for saving the power, the pulse must be continued until the oscillation will terminate at the front and rear stage of the sustaining pulse. Otherwise no power saving can be effected. More especially in a case as mentioned above if a complicated oscillation is produced inside of the panel and the time for attenuation may vary greatly, the pulse width at the front stage and rear stage should be sufficiently long. The required pulse width may become large compared with the main portion of the sustaining pulses.

Whereas the second embodiment of the invention has its object to suppress the production of oscillation in the waveform due to resistance, inductance and capacitance of the discharge display panel. The pulse width may be sufficiently narrow like 100 ns to 500 ns and also the pulse waveform change is applied only at the front stage of the sustaining pulse. Thus the method is clearly different from the above mentioned known system.

As has been explained in detail in the above, according to the present invention, the waveform of the sustaining pulse in a memory type gas discharge display panel is arranged to have gentle rise-up or stepwise rise-up a stable sustaining pulse margin can be obtained by suppressing the oscillation of the waveform appearing due to variation of the circuit parameters. Also the difference in the rise-up produced due to the difference of oscillation behaviour and resulting luminous ununiformity can be decreased. Furthermore the load for the driving circuit may not be increased substantially.

What is claimed is:

1. A method for driving a discharge display panel of pulse memory type comprising at least two sets of electrodes arranged oppositely to form a plurality of discharge cells arranged in matrix form, comprising: applying said discharge cells with sustaining pulses intermittently so that a sustaining pulse discharge started by a write-in pulse may continue until an application of an erasing pulse, wherein a duration taken from beginning of rise-up of the sustaining pulse and establishment of the sustaining pulse voltage is set at 150 ns to 500 ns.

2. A method for driving a discharge display panel as claimed in claim 1, wherein a waveform of a rise-up portion of the sustaining pulse is selected from one of exponential, linear and cosine function form.

3. A method for driving a discharge display panel as in claim 1, wherein the waveform of a rise-up portion of the sustaining pulse has a stepwise form.

4. A method for driving a discharge display panel as claimed in claim 3, wherein the waveform in the rise-up portion has a two step form.

5. A method for driving a discharge display panel of pulse memory type comprising at least two sets of electrodes arranged oppositely to form a plurality of discharge cells arranged in matrix form, said method comprising: applying said discharge cells with sustaining pulses intermittently so that a sustaining pulse discharge started by a write-in pulse may continue until an application of an erasing pulse, wherein a rise-up portion of the sustaining pulses has a two step waveform, a first step voltage of said rise-up portion being selected to be 30 to 80% of the established maintaining voltage of said rise-up portion, and a duration from a first step rise-up time to a second step rise-up time of said rise-up portion is selected to be 100 ns to 500 ns.

* * * * *